US007887321B2

(12) United States Patent
Burtea et al.

(10) Patent No.: US 7,887,321 B2
(45) Date of Patent: Feb. 15, 2011

(54) BURNER PLATE ASSEMBLY FOR A GAS OVEN

(75) Inventors: Constantin Burtea, Lindenhurst, IL (US); Sanda Burtea, legal representative, Lindenhurst, IL (US); Frank Anthony Agnello, South Elgin, IL (US); Don Van Erden, Wildwood, IL (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 12/754,287

(22) Filed: Apr. 5, 2010

(65) Prior Publication Data

US 2010/0190123 A1 Jul. 29, 2010

Related U.S. Application Data

(62) Division of application No. 11/692,424, filed on Mar. 28, 2007, now Pat. No. 7,717,704.

(51) Int. Cl.
*F23D 14/14* (2006.01)

(52) U.S. Cl. ..... 431/326; 431/7; 431/328; 431/329; 431/354; 48/189.6; 110/295; 126/512

(58) Field of Classification Search ..... 431/7, 431/125, 326–329, 354; 48/189.6; 110/295; 126/222–225, 512; D9/427, 432, 500, 686, D9/743, 744; *F23D 14/14*
See application file for complete search history.

(56) References Cited

U.S. PATENT DOCUMENTS

| | | | | |
|---|---|---|---|---|
| 387,811 | A * | 8/1888 | Rader | 431/329 |
| 1,240,757 | A * | 9/1917 | Mortland et al. | 220/6 |
| 1,968,395 | A * | 7/1934 | Henson | 431/278 |
| 3,084,736 | A | 4/1963 | Mentel et al. | |
| 3,129,749 | A | 4/1964 | Honger | |
| 3,188,366 | A * | 6/1965 | Flynn | 432/9 |
| 3,199,573 | A * | 8/1965 | Fiynn | 431/329 |
| 3,439,996 | A * | 4/1969 | Lherault et al. | 431/328 |

(Continued)

FOREIGN PATENT DOCUMENTS

| | | |
|---|---|---|
| DE | 195 11 683 | 11/1995 |

(Continued)

OTHER PUBLICATIONS

Office action mailed Jan. 22, 2009, in U.S. Appl. No. 11/692,465.

*Primary Examiner*—Steven B McAllister
*Assistant Examiner*—Daniel E Namay
(74) *Attorney, Agent, or Firm*—Kelly & Krause, L.P.; Joseph P. Krause

(57) ABSTRACT

A wire mesh burner plate for use in large, gas burners for large ovens is comprised of spaced-apart wire mesh plates. The spacing between the wire mesh plates defines an air/fuel mixture space. The fuel passes through the lower or first mesh, experiences a pressure drop, mixes with air and passes through a second wire mesh. The gas combusts after passing through the second wire mesh. The fine gauge of the mesh prevents combustion from flowing backwardly into the fuel/air mixture space. Several individual wire mesh burner plates can be flexibly attached to each other such that a very wide space can be covered. Thermal stresses are reduced by being distributed across multiple burners.

14 Claims, 4 Drawing Sheets

U.S. PATENT DOCUMENTS 3,556,707 A * 1/1971 Hine, Jr. ..... 431/328
4,547,148 A * 10/1985 Holmer ..... 431/328
4,739,154 A 4/1988 Bharara et al.
5,174,744 A 12/1992 Singh
5,296,683 A 3/1994 Burkett et al.
5,571,009 A 11/1996 Stalhane et al.
5,676,870 A 10/1997 Wassman et al.
5,989,013 A 11/1999 Gray
5,990,454 A 11/1999 Westerberg et al.
6,030,206 A * 2/2000 Shizukuisha et al. ..... 431/328
6,069,345 A 5/2000 Westerberg
6,193,932 B1 * 2/2001 Wu et al. ..... 422/28
6,369,360 B1 4/2002 Cook
6,659,765 B1 12/2003 Sen-Yu
6,672,302 B1 * 1/2004 Voorhis et al. ..... 126/39 R
6,707,014 B1 3/2004 Corey et al.
6,867,399 B2 3/2005 Muegge et al.
6,872,926 B1 3/2005 Arntz et al.
6,896,512 B2 5/2005 Rattner et al.
2005/0136368 A1 * 6/2005 Malloy et al. ..... 431/354
2005/0173400 A1 8/2005 Cavada et al.
2006/0003279 A1 1/2006 Best
2006/0154191 A1 * 7/2006 Gilioli et al. ..... 431/129
2007/0298361 A1 * 12/2007 Fogliani et al. ..... 431/354
2009/0032012 A1 * 2/2009 von Herrmann et al. ... 126/39 J

FOREIGN PATENT DOCUMENTS

JP 58035314 A * 3/1983
JP 08285238 A * 11/1996

* cited by examiner

BURNER PLATE ASSEMBLY FOR A GAS OVEN

BACKGROUND

This invention relates to ovens. More particularly, this invention relates to a burner plate for use with a gas burner that can be used to generate infrared heat.

Convection ovens cook food using heated air and are slow. Microwave ovens on the other hand are very fast. They pass microwaves, usually at a wavelength of about 12 cm. through food. Water, fat and other substances in the food absorb energy from the microwaves. Microwave ovens are generally used for time efficiency in both industrial applications such as restaurants and at home, rather than for cooking quality because a microwave oven cannot brown food.

Infrared ovens are generally faster than convection ovens because they use infrared radiation, but they are slower than microwave ovens. Of the various wavelengths of IR, short wavelength infrared is known to penetrate food more deeply than long-wavelength infrared and therefore cooks faster than long wavelength IR.

A problem with infrared ovens is the time required to heat an element to the temperature at which it will emit short wavelength IR. An energy efficient source of short-wavelength infrared that heats quickly would be an improvement over the prior art. More particularly, an oven that directs infrared onto a food being cooked from both above and below the item would be an improvement over the prior art.

SUMMARY

A burner plate for a gas-fired oven burner is provided by a parallelpiped formed from perforated stainless steel sheet and having a hollow interior. The open interior of the burner plate provides an air/fuel mixing space wherein gaseous fuel and combustion air are mixed. The gas-air mixture combusts above the wire-mesh parallel piped to heat a wire screen until it emits infrared. By loosely connecting several separate wire mesh burners together, thermal expansion and contraction is accommodated by the connections between the burners as well as the mesh material they are formed from. A very large burner plate can be provided by several individual wire mesh burners.

DETAILED DESCRIPTION

Figure 1:
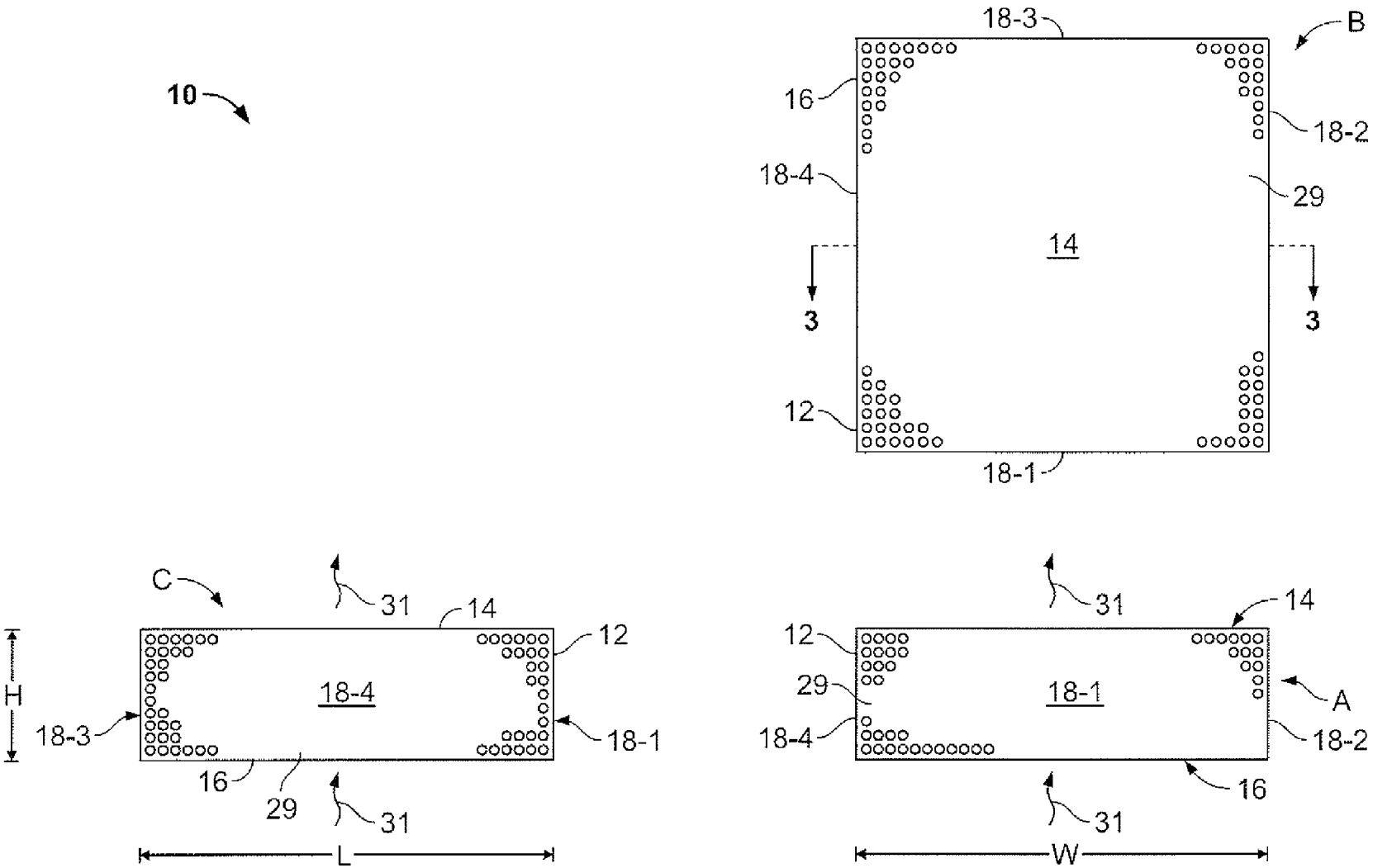
FIG. 1 shows the front, top and side views of a mesh burner plate for a gas oven burner.

FIG. 1 shows the front, top and side views of a burner plate 10 for a gas oven burner (not shown). In FIG. 1, the front view is identified by reference letter A; the top view is identified by reference letter B and the side view is identified by reference letter C. As can be seen in FIG. 1, the burner plate 10 is in the shape of a parallelepiped, the mathematical definition of which is a 6-faced polyhedron, all of the faces of which are parallelograms lying in pairs of parallel planes.

In one embodiment, the burner plate 10 is formed from perforated stainless steel sheet, the holes 16 of which are so numerous, small and closely spaced such that the perforated sheet resembles a wire mesh. For clarity, the material from which the burner plate 10 is formed is referred to hereinafter as "mesh" and/or "wire mesh" but such a term includes a mesh material literally as well as perforated sheet material.

The holes 16 in the mesh are formed to extend completely through the mesh material to allow gases to pass through. The mesh material is of course heat tolerant because fuel gas that passes through the burner plate 10 combusts immediately after passing through the burner plate's major faces 14 and 22 with the combustion occurring adjacent to one of the major faces 14 or 22. As stated above, the mesh in a preferred embodiment was made from stainless steel however, other heat tolerant materials into which small holes can be formed or made are also usable, examples of which include ceramic mesh, perforated ceramic sheets and ceramic-coated stainless steel.

The parallelepiped burner plate 10 of FIG. 1 has first and second major faces 14 and 22, which are the widest faces of the parallelepiped. The first and second major faces 14 and 22 are substantially rectangular and spaced apart from each other by a distance H. The major faces 14 and 22 are also considered to oppose or face each other.

The burner 10 has four sides 18-1 through 18-4, each of which is orthogonal or substantially orthogonal to the opposing major faces 14 and 22 and which are also made from the mesh from which the major faces 14 and 22 are made. The burner plate 10 has a width W and a length L. It also has a depth or height H, defined by the distance between the first and second opposing faces 14 and 22. An open space or volume within the interior of the burner plate 10, i.e., between the opposing major faces 14 and 22 and between the sides 18-1 through 18-4, define the air/fuel mixture space 29.

Fuel gas and combustion air 31 that passes through a first one of the major faces (14 or 22) experiences a small but non-zero pressure drop after it passes through the holes in the face (14 or 22). The gas' momentum and its expansion upon passing through one of the faces (14 or 22) create turbulence in the air/fuel mixture space 29, which causes the fuel gas and combustion air to mix. The continued delivery of fuel gas and combustion air through one of the major faces (14 or 22) will cause the fuel gas and combustion air to be forced out the other major face (22 or 14) where it is ignited and will combust so long as fuel and combustion air continue to be supplied. The hole 16 diameter and the gas flow itself prevent ignition and combustion from occurring within the air/fuel mixture space 29.

As set forth above, fuel gas combustion occurs immediately adjacent to one of the major faces (14 or 22), after the fuel gas has passed through the burner plate 10. Both of the burner plate 10 major faces 14 and 22 as well as the side walls 18 are subjected to intense heat and great temperature fluctuations whenever the burner 10 is heated. While the burner plate 10 is in the shape of a parallelepiped, those of ordinary skill in the art will recognize that the burner plate faces 14 and 22 and the four sides 18-1 through 18-4, will not line in precise geometric planes due in part to the heat the causes expansion and contraction and distortion as the mesh material is repeatedly heated and cooled. The faces 14 and 22 and the sides 18 are approximately planer. For purposes of this disclosure and claim construction, any reference to the faces 14 and 22 and the sides 18 as being "planar" or lying in planes, should be construed to mean that a physical embodiment will be substantially planar and will of course include some amount of bending, undulations, warping, flexing and other deviations from a pure, geometric plane.

In FIG. 1, the intersections of the major face 14 and 22 edges and the edges of the sides 18 are depicted in FIG. 1 as lines. In other words, FIG. 1 does not depict any seams or connections between the faces 14 and 22 and the sides 18.

In one alternate embodiment, the six faces of the burner plate 10 can be extruded from a solid material so that there are no joints or seams where the faces 14 22 meet the sides 18. In such an embodiment, the small diameter and regularly spaced holes that allow gas to pass through the burner 10 can be formed after the extrusion process, such as by perforation.

In another embodiment, a single panel of wire mesh or perforated sheet steel can be cut or stamped and folded along pre-determined fold lines, origami-like, to form a parallelepiped-shaped burner plate 10. Open edges of the origami-like parallelepiped shape are welded or mechanically joined together.

In another embodiment, the six faces of the burner plates 10 can be formed from six different pieces of planar wire mesh material or perforated sheet steel and then joined to each other at the corners formed by the intersection of the major faces 14 and 22 to the sides 18. The major faces 14 and 22 can be joined to the sides 18 by welding or an appropriate, heat tolerant adhesive. The faces 14 and 22 and the side 18 could also be riveted, bolted or screwed to small angle brackets either inside or outside the air/fuel mixture space 29.

Figure 2:
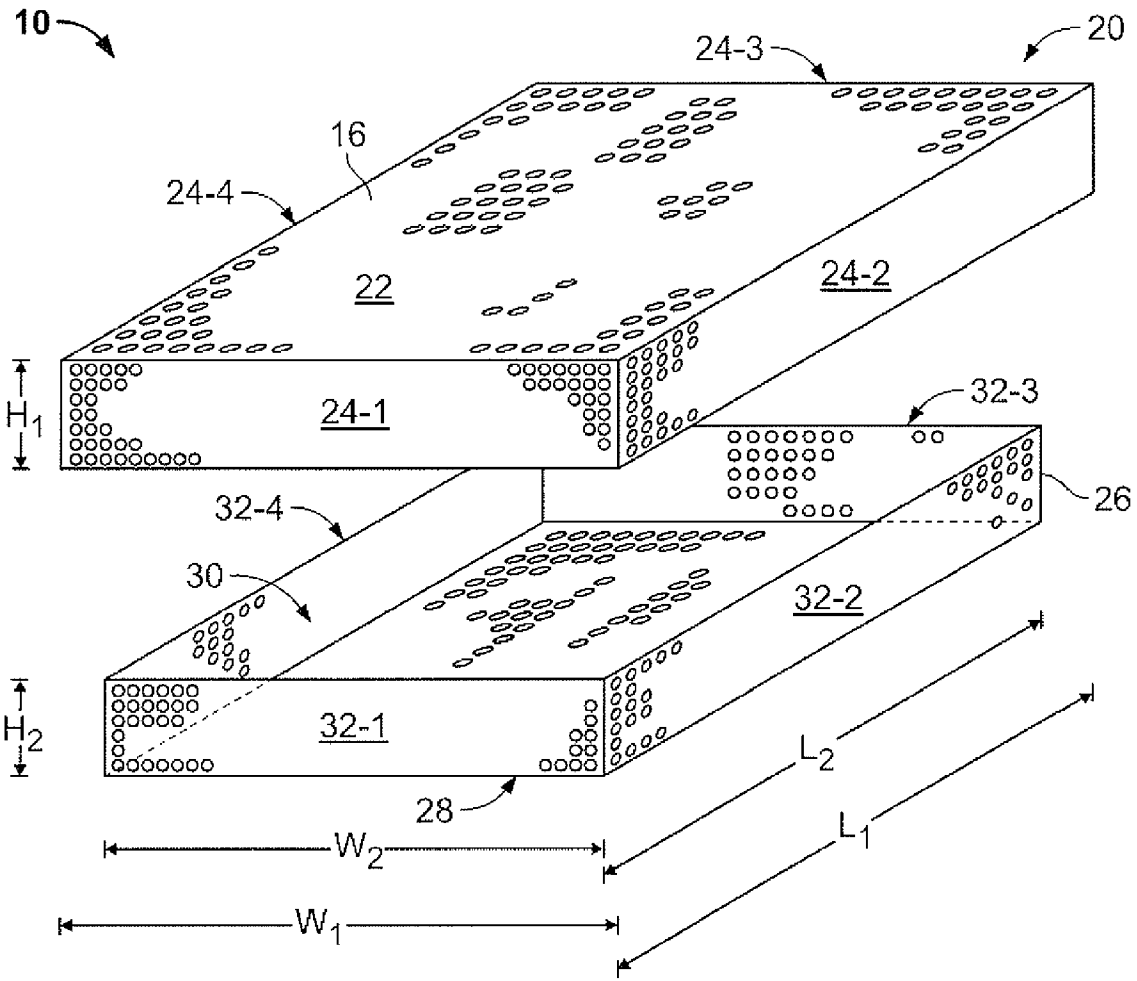
FIG. 2 shows a perspective view of a mesh burner plate constructed from open-faced or open-top parallelepipeds.

In a preferred embodiment depicted in FIG. 2, however, the parallelepiped-shaped burner plate 10 is assembled from two separate "open-top" or "open face" parallelepiped halves or pieces 20 and 26, each of which is formed from the aforementioned perforated stainless steel sheet such that when the two open-top parallelepipeds are nested together, they also form a shape that also resembles a parallelepiped.

In FIG. 2, a top or "first" open-faced parallelepiped 20 is formed from a single piece of wire mesh, which is considered to include perforated sheet steel, so that the first parallelepiped 20 has a first major face 22 of mesh material and four mesh material sides 24-1, 24-2, 24-3 and 24-4. In this embodiment, the mesh material is stainless steel, which allows the sides 24 to be formed by bending or folding until the sides 24 are orthogonal or substantially orthogonal to the first major face 22. Importantly, the second major face of the top or "first" parallelepiped 20 is open, i.e., it is missing. Because one major face is missing from the parallelepiped, the first parallelepiped 20 is referred to as an "open-faced" or an "open-top" parallelepiped. The top or first open-faced parallelepiped nevertheless has a first width, W1, a first length, L1 and a first depth or height, H1 as shown in FIG. 2.

A bottom or "second" open-faced parallelepiped 26 is also formed from wire mesh. The second parallelepiped 26 also has a first major face 28 that is formed from the wire mesh. Like the first or top open-faced parallelepiped 20, the second parallelepiped 26 has its second major face 30 missing or open. Four wire mesh sides 32-1, 32-2, 32-3 and 32-4 are bent or otherwise shaped to be orthogonal or substantially orthogonal to the first major face 28.

Similar to the first open-top parallelepiped 20, the second open-top parallelepiped 26 has a width, W2, a length, L2, and a depth or height H2, however, the dimensions of the width W2 and the length L2 are less than W1 and L1 in order to allow the second open top parallelepiped 26 to fit snugly within, i.e., nest within, the first parallelepiped 20.

Figure 3:
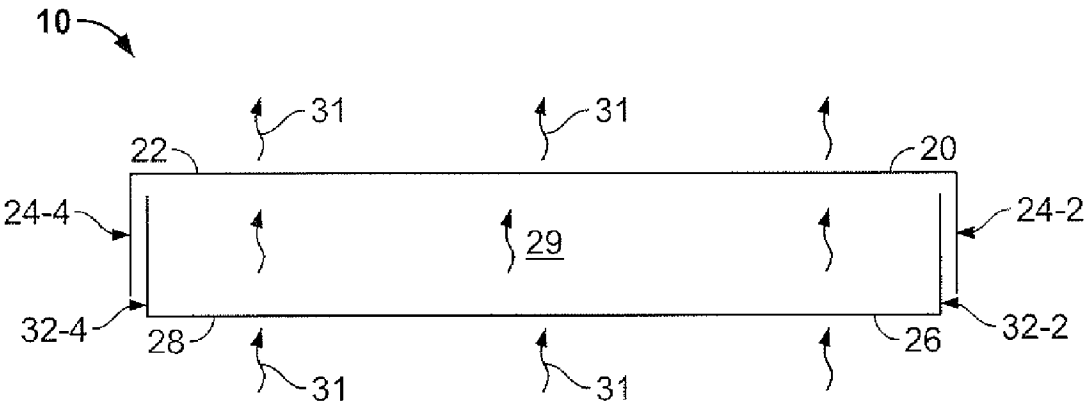
FIG. 3 shows a cut-away view of the mesh burner plate of FIG. 2.

FIG. 3 is a cross section taken along the section lines 3-3 of view "B" in FIG. 1. As such, FIG. 3 depicts nesting the second open-top parallelepiped 26 within the first open-top parallelepiped 20 shown in FIG. 2. Note that the Open or missing major face of the second open-top parallelepiped 26, is located completely within the volume enclosed by the faces of the first open-faced parallelepiped 20. The open face of the second open-top parallelepiped is also adjacent to, or abutting, the first major face 22 of the first open-top parallelepiped 20. Similarly, the open or missing major face of the first open-top parallelepiped 20, abuts or is adjacent to the first major face 28 of the second open-top parallelepiped 26. Such a configuration is referred to herein as one parallelepiped (26) being "nested" within the other parallelepiped (20). The depth or heights of the parallelepipeds 20 and 26 define an air/fuel mixture space 29 enclosed within wire mesh wherein fuel and combustion air 31 are mixed. The fuel and air 31 passes through the bottom or second parallelepiped 26, into the air/fuel mixture space 29, and from the air/fuel mixture space 29 through the top or first parallelepiped 20 where it is ignited and combusts.

In a preferred embodiment, the air/fuel mixture space 29 height H is approximately one-half inch. In alternate embodiments, however, the air/fuel mixture space 29 can be any space between about three-fifths of an inch to about one inch.

In all of the embodiments described above, the mesh burner plate 10 is comprised to two substantially planar and spaced-apart wire mesh plates (14 and 22 in FIGS. 1; 20 and 26 in FIGS. 2 & 3), which can be considered to lie in substantially horizontal and substantially parallel geometric planes. The plates have closely and regularly-spaced holes or openings 16 that extend completely through the constituent material so that gas 31 can flow through the holes 16 in the plates with combustion occurring just above but adjacent to one of them.

Depending on the orientation of the burner plate 10 in an oven, i.e, whether it is mounted to project heat upwardly or downwardly, and depending on the direction of gas flow through the burner plate 10, one of the plates (16 in FIGS. 1 and 26 in FIG. 2) can be considered an inlet screen vis-a-vis the air/fuel mixture space 29. The other plate (i.e., 14 in FIGS. 1 and 20 in FIG. 2) can be considered an outlet screen, against which fuel combustion takes place.

In a preferred embodiment, the holes 16 in both plates are the same or substantially the same size, i.e., large enough to permit a gaseous fuel/air mixture 18 to flow through them with only a small pressure drop. A pressure drop across the first or lower plate, i.e., the inlet plate, will induce or enhance turbulence and thereby induce or enhance the mixing of the fuel gas with combustion gas.

In an alternate embodiment, holes 16 in the inlet plate can be made larger than the holes 16 in the second or top plate to reduce or eliminate a pressure drop and to increase the volumetric flow rate of gases through the burner plate 10. Conversely, the holes in the inlet plate can be made smaller than the holes in the outlet plate to increase the pressure drop at the inlet plate and to thereby increase turbulence through the inlet plate, increasing the mixture of fuel gas and combustion air. Larger holes in the outlet plate should produce less turbulence through the outlet plate and should result in a combustion flame being held closer to the outlet plate as well as possibly providing a more uniform temperature.

Figure 4:
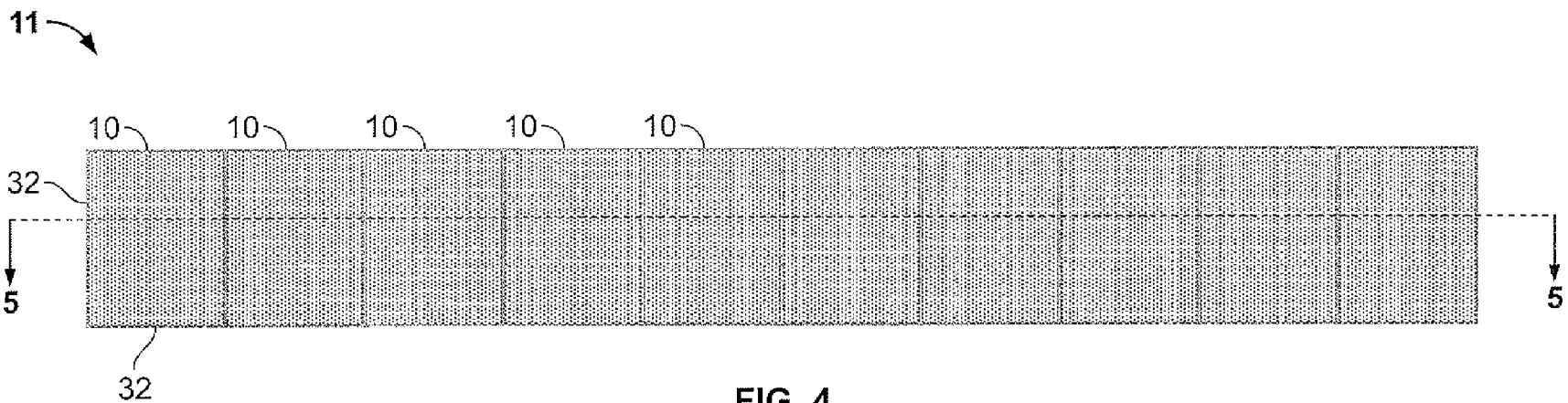
FIG. 4 shows a top view of a mesh burner plate constructed from several mesh burner plates of FIG. 2.
Figure 5:
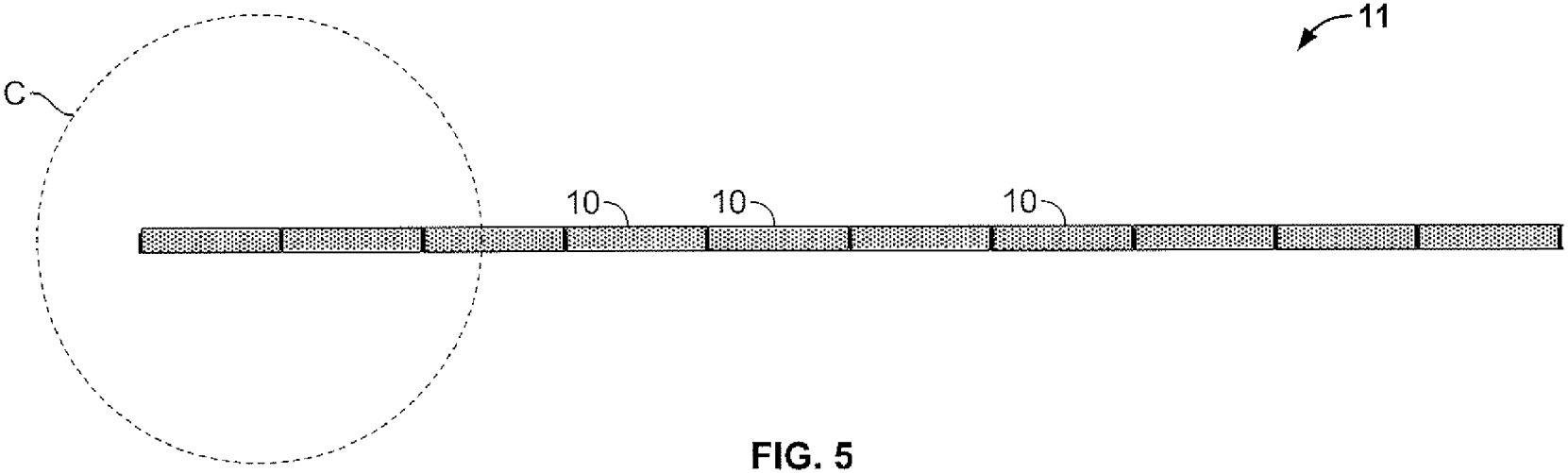
FIG. 5 shows a cross-section of the burner plate of FIG. 4.
Figure 6:
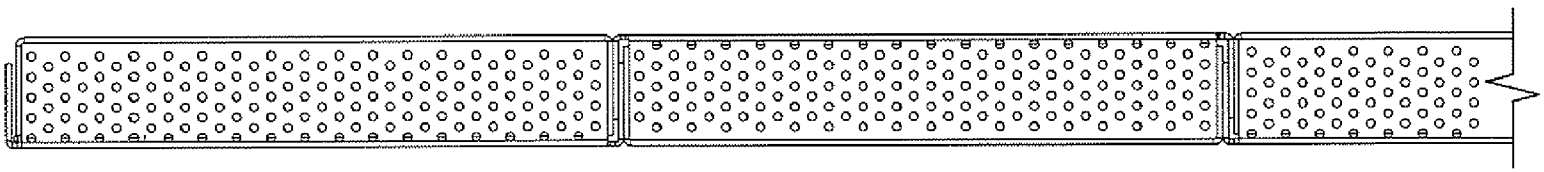
FIG. 6 shows an isolated view of the connections between two individual plates of FIG. 5.
Figure 7:
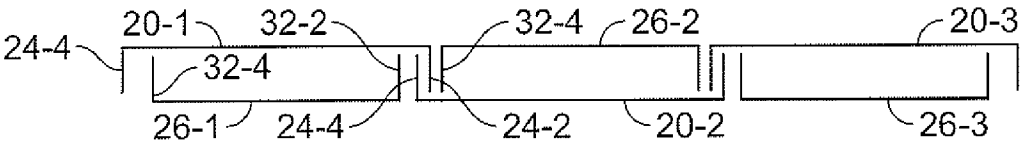
FIG. 7 is a view of the connection between the burner plates shown in FIG. 4.

As set forth above, the burner plates 10 described above are for use in a gas-fired oven, however, the area of the burner plate 10 and hence its ability to distribute heat uniformly is limited by its length and width. A much wider and/or longer gas burner and much wider heat distribution can be realized by coupling several of the burner plates 10 together, side-by-side as well as end-to-end FIG. 4 is a top view of an elongated burner plate 11 comprised of several of the individual burner plates 10 depicted in FIG. 2 connected together, side-to-side. FIG. 5 shows a cross-section of the elongated burner plate 11 shown in FIG. 4. FIG. 6 shows a depiction of the connection of two of the burner plates 10 shown in FIG. 2. FIG. 7, however, exaggerates the size differences between the open-top parallelepipeds 20 and 26 in order to more clearly show how a series of the burner plates 10 of FIG. 2 can be readily connected to each other by simply alternating the larger and smaller open-top parallelepipeds 20 and 26 so that their sides can be interlocked.

In FIG. 7, a first large open-top parallelepiped 20-1 faces downwardly and nests with a first small open-top parallelepiped 26-1 within it. A second large open-top parallelepiped 20-2 lies to the right of the first open-top parallelepiped 20-1 facing upwardly and nests with a second, small open-top parallelepiped 26-2 within it. Note, however, that the "right" side 24-2 of the first downwardly-facing open-top parallelepiped 20-1 is interlocked with, i.e., hangs over, the "left" side 24-4 of the second, upwardly-facing large open-top parallelepiped 20-2. Similarly, the "right" side of the second, upwardly-facing large open-top parallelepiped is engaged with the "left side of a third, downwardly-facing large open-top parallelepiped 20-3.

As can be seen in FIG. 7, by inverting every-other large open-top parallelepiped 20, the adjacent sides of them can be interlocked and frictionally held in place by small open-top parallelepipeds 26 that are nested into each of the large open-top parallelepipeds 20. An extended burner plate 11 formed in this way can be constructed to provide very wide parallel plate wire mesh burner plates 11 for use in gas fired burners and ovens.

In an alternate embodiment, a burner plate assembly 11 is made from several of the burner plates 10 depicted in FIGS. 1 and 2 interlocked at their narrow sides, i.e., sides identified by reference numerals 18-1 and 18-3 in FIG. 1 and the sides identified by reference numerals 24-1 and 24-3 in FIG. 2. In yet another alternate embodiment, a burner plate assembly 11 is made from several burner plates 10 hooked together at both their long sides and the narrow sides to provide a long and wide burner plate assembly. When the burner plate assembly is made from burner plates of FIG. 2 and FIG. 3 connected along both the narrow and long sides, they are arranged in a checkerboard pattern, i.e., with every other burner plate being a large open-top parallelepiped next to a smaller open-top parallelepiped.

As the assembly of burner plates 10 shown in FIGS. 4-7 are heated and cooled over time, each of the burner plates 10 will expand and contract. By using several small burners 10, however, thermally induced stress is better absorbed by multiple burners 10 than it would be by a one large burner.

In order to keep gas from leaking through the burner side walls, a gasket, not shown, is formed from a non-combustible strap, which wraps around the side walls to prevent fuel gas and air from leaking through the holes 16 in the side walls.

In one embodiment, the holes 16 were round, and approximately 0.045 inches in diameter. The holes are aligned in "horizontal" rows (for purposes of this paragraph) with the center-to-center hole spacing between adjacent rows, i.e., a row above or below a "horizontal" row, being approximately 0.074 inches. The center-to-center hole spacing between holes in the same horizontal row is approximately 0.086 inches. The hole centers in adjacent horizontal rows are offset from each other such that a sixty degree angle is formed between a line extending horizontally through the centers of the holes in one horizontal row and a line extending through the centers of the holes in vertically adjacent rows, i.e., rows above or below a horizontal row. The center-to-center spacing of two holes adjacent to each other in adjacent vertical rows is about 0.086 inches. In an alternate embodiment, the holes 16 are either rectangular, elliptical, triangular or diamond-shaped or a combination of shapes.

Since the fuel/air mixture combusts above the plate 12, a large number of openings 14 are preferred over a small number of openings in order to provide a substantially continuous blanket of fuel. In a preferred embodiment, the dimensions of a single burner plate using wire mesh having the hole sizes and arrangement described above was approximately 2.05 inches by 3.75 inches with a thickness of approximately one-half inch.

The foregoing description provides examples of a preferred embodiment. It should not be construed as, or considered to be, limiting the scope of the invention. Rather the scope of the invention is defined by the appurtenant claims.

What is claimed is:

1. A burner plate assembly comprising:

a first, open-faced parallelepiped formed from wire mesh, the first open-faced parallelepiped having a first major face, four sides and an open second face that opposes the first major face, the four sides being substantially orthogonal to the major faces and having a first height dimension, which determines a first separation distance between the first and second major faces, first and second ones of the four sides being opposite each other and having a first length, third and fourth ones of the four sides being opposite each other and substantially orthogonal to the first and second sides, and having a second length, the first open-faced parallelepiped having a first parallelepiped length defined by the first length, a first parallelepiped width defined by the second length, and having a first parallelepiped height defined by the distance between the first and second major faces;

a second open-faced parallelepiped formed from wire mesh, the second open-faced parallelepiped having a first major face, four sides and an open second face that opposes the first major face, the four sides being substantially orthogonal to the major faces and having a second height dimension, which determines a second separation distance between the first and second major faces, first and second ones of the four sides of the second, open-faced parallelepiped being opposite each other and having a third length, which is less than the first length, third and fourth ones of the four sides of the second, open-faced parallelepiped being opposite each other and substantially orthogonal to the first and second sides of the second, open-faced parallelepiped and having a fourth length, which is less than the second length, the second, open-faced parallelepiped having a second parallelepiped length defined by the third length, a second parallelepiped width defined by the fourth length, and a second parallelepiped height defined by the distance between the first and second major faces of the second, open-faced parallelepiped, the second open-faced parallelepiped being nested within the first open-faced parallelepiped such that the open face of the second open-faced parallelepiped is within and adjacent the first major face of the first open-faced parallelepiped;

a third open-faced parallelepiped, substantially identical to the first open-faced parallelepiped such that it has a first parallelepiped height, first parallelepiped length and a first parallelepiped width, the third, open-faced parallelepiped being interlocked with the nested first and second open-faced parallelepipeds by the engagement of a first one of the four sides of the third open-faced parallelepiped, between corresponding ones of the sides of the nested, first and second open-faced parallelepipeds.

2. The burner plate assembly of claim 1, further comprised of a plurality of nested open-faced parallelepipeds, interlocked with each other by the engagement of opposing, first and second ones of the sides, between corresponding ones of the sides of adjacent nested open-faced parallelepipeds, the plurality of nested, open-faced parallelepipeds forming an elongated, wire mesh burner plate.

3. The burner plate assembly of claim 2, wherein the nested parallelepipeds define an air/fuel mixture space enclosed within wire mesh.

4. The burner plate assembly of claim 1, wherein the first parallelepiped height is greater than the second parallelepiped height.

5. The burner plate assembly of claim 1, wherein the first parallelepiped height is substantially equal to the second parallelepiped height.

6. The burner plate assembly of claim 1, wherein the first parallelepiped height is less than the second parallelepiped height.

7. The burner plate assembly of claim 1, wherein the first parallelepiped length and the first parallelepiped width are substantially equal to each other, such that the nested parallelepipeds form a closed, substantially square, wire mesh burner plate.

8. The burner plate assembly of claim 7, wherein the second parallelepiped length and the second parallelepiped width are substantially equal to each other.

9. The burner plate assembly of claim 1, wherein the first, second and third open parallelepipeds are comprised of the same type of wire mesh.

10. The burner plate assembly of claim 1, wherein holes in the mesh each have an area of about 0.0015 square inches.

11. The burner plate assembly of claim 3, wherein the air/fuel mixture space is between about three-fifths of an inch and about one inch.

12. The burner plate assembly of claim 1 wherein the mesh of the first major face of the first open-faced parallelepipeds is comprised of holes having a first area, and wherein the mesh of the first major face of the second open-faced parallelepipeds is comprised of holes having a second area, the first area being different than the second area.

13. The burner plate assembly of claim 1, wherein the wire mesh is stainless steel.

14. The burner plate assembly of claim 1, wherein the wire mesh is ceramic-coated stainless steel.

* * * * *